United States Patent [19]

Taylor

[11] Patent Number: 4,761,849

[45] Date of Patent: Aug. 9, 1988

[54] WASHCLOTH

[76] Inventor: Norma L. Taylor, 3171 Celt Cove, Memphis, Tenn. 38118

[21] Appl. No.: 787,497

[22] Filed: Oct. 15, 1985

[51] Int. Cl.[4] ..... A61H 7/00

[52] U.S. Cl. ..... 15/222; 15/227

[58] Field of Search ..... 15/222, 227, 209 D, 15/208, 209 R; 2/67, 174, DIG. 6

[56] References Cited

U.S. PATENT DOCUMENTS

| | | | |
|---|---|---|---|
| 968,924 | 8/1910 | Enge | 15/227 |
| 1,404,401 | 1/1922 | Novick | 15/222 X |
| 1,521,935 | 1/1925 | Elwell | 15/227 |
| 1,598,574 | 8/1926 | Gibson | 15/222 |
| 1,681,031 | 8/1928 | Forbes | 15/208 |
| 2,035,014 | 3/1936 | Schaefer | 15/222 |
| 2,372,556 | 3/1945 | David | 15/208 |
| 2,739,335 | 3/1956 | Herman | 15/222 |
| 3,514,802 | 6/1970 | Keech | 15/208 |
| 3,812,849 | 5/1974 | Guinta | 15/222 |
| 3,875,933 | 4/1975 | Schwab | 15/222 X |
| 4,457,640 | 7/1984 | Anderson | 15/227 X |
| 4,698,854 | 10/1987 | Slimmon | 15/222 X |

OTHER PUBLICATIONS

Gershman Journal of A.M.A., vol. 168, No. 7, "Self-Adhereing Nylon Tapes", 10-19-1958, p. 980.

*Primary Examiner*—Chris K. Moore

[57] ABSTRACT

This cloth is for bathing one's face, other areas of the body, and also, the back. Primarily, it consists of a panel of cloth which is stretchable and is provided with a handle on the ends for using it on one's back, or when folded, the handles may be used to carry the cloth with toilet or other articles inside. The ends of the panel are also provided with velcro fasteners for keeping the cloth closed when it is folded.

2 Claims, 1 Drawing Sheet

FIG. 1
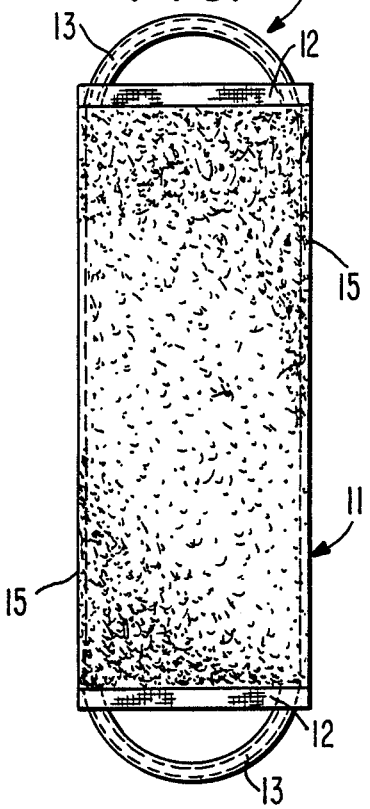
FIG. 2
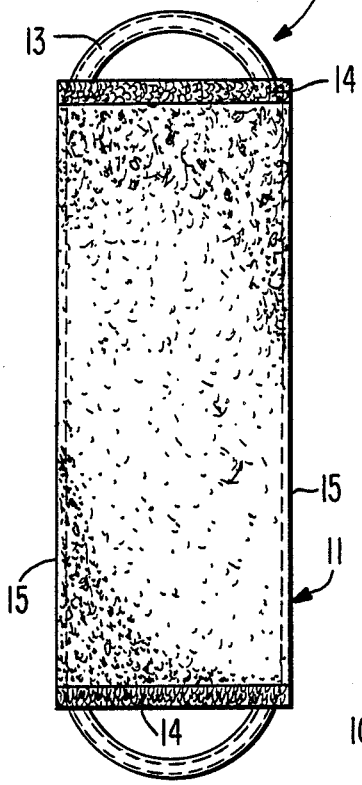
FIG. 3
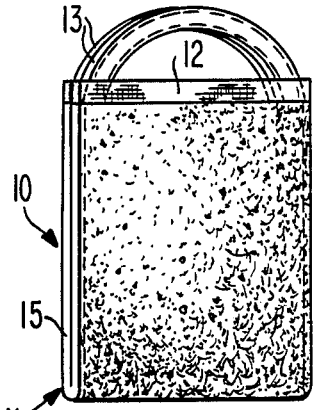
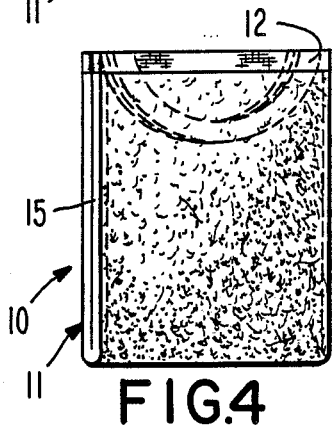
FIG.4
FIG.7
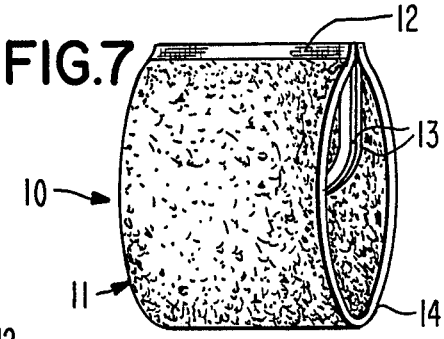
FIG.5
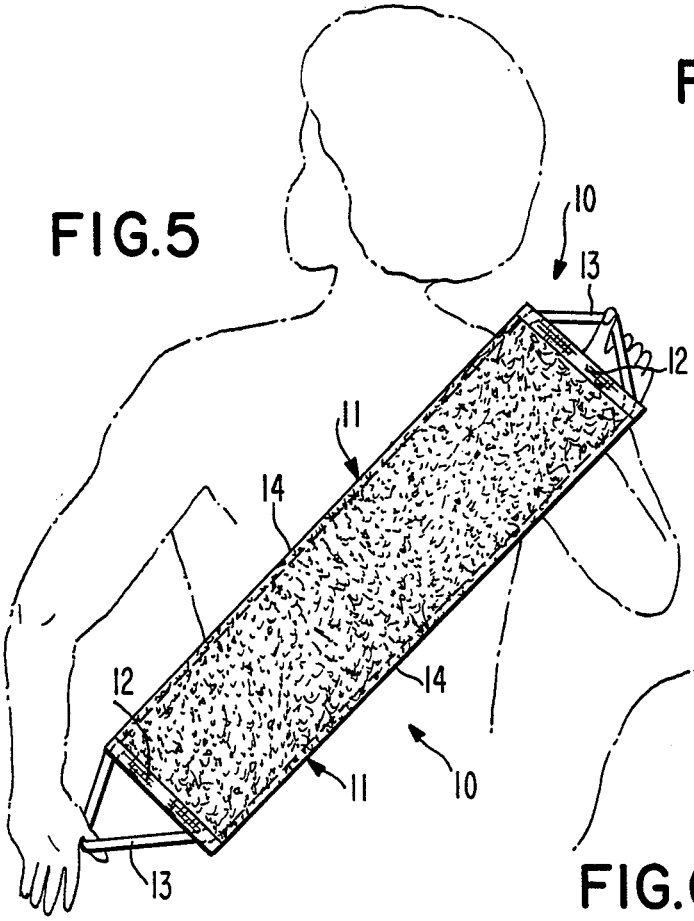
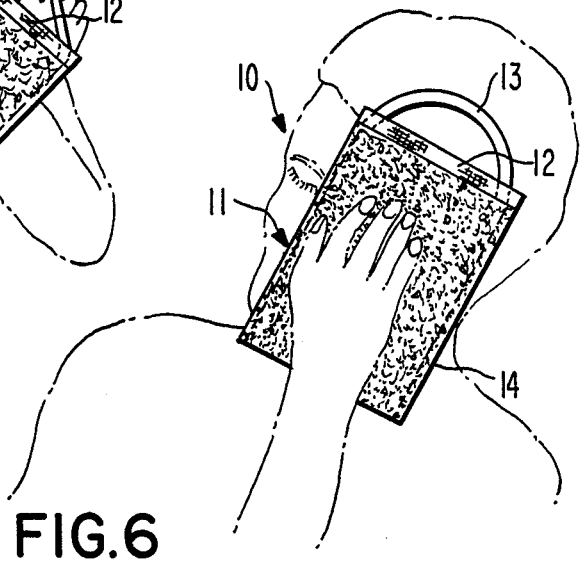
FIG.6

WASHCLOTH

BACKGROUND OF THE INVENTION

1. Field of the Invention

This invention relates to a bath cloth, and more particularly, to a stretch washcloth for bathing.

b 2. Description of Prior Art

References of record are the U.S. Pat. Nos. of W. Novik 1,404,401, E. G. Schaefer 2,035,014, E. Schirmer 2,363,697, and C. F. J. Dupuy 2,829,392.

The principal object of this invention is to provide a stretch washcloth for bathing, which will be unique, in that it may be effectively employed as a face cloth, a body cloth, and a back scrubber, and whether folded or unfolded, it serves the various parts of the anatomy with ease and comfort.

Another object of this invention is to provide a stretch washcloth for bathing, which will be made of terry cloth or velour, either cotton, polyester fabric, or a combination of both, and it is especially adaptable for single persons alone and those who are handicapped and have no one to help them bathe, particularly hard to reach areas, such as the back.

A further object of this invention is to provide a stretch washcloth for bathing, which will further be unique, in that when folded, it can carry such items as soap, a brush, and other items, especially when camping and having to use bath houses.

BRIEF DESCRIPTION OF THE DRAWINGS

FIG. 1 is a front elevational view of the present invention;

FIG. 2 is a rear elevational view of the invention;

FIG. 3 is a perspective view of the invention, shown folded;

FIG. 4 is similar to FIG. 3, but illustrated with the handles inside;

FIG. 5 is an illustration showing the invention employed as a back washcloth;

FIG. 6 illustrates the invention in use as a face and body cloth, and

FIG. 7 is a perspective view of the invention, shown folded inside-out.

SUMMARY OF THE INVENTION

A washcloth for the face, the body, and the back, comprising a terry cloth or other suitable material panel, having a handle of similar material on each end, and provided with velcro fastener means for holding it in folded condition. The cloth, when folded, may also be employed to support and carry toilet articles, such as soap, a comb, a toothbrush, etc.

DETAILED DESCRIPTION

Accordingly, a washcloth 10 is shown to include a panel 11, which is of terry cloth or other suitable material that is easily laundered and sterilized in a regular laundry wash. Panel 11 is preferably, but not limited to, a finished length and width of ten and a half by twenty-five inches, and when folded, ten and a half by twelve and a half inches. Each end of panel 11 is provided with a hem 12. A handle 13 of similar material and of triple thickness, is preferably, but not limited to, ten and a half by one inches and is secured to each end of panel 11, and a pair of mating velcro fasteners 14, which are three quarters by ten and a half inches, are suitably attached to the hems 12, so as to fold panel 11 shut when desired.

Each finished side edge 15 is either hemmed or provided with a woven border, and when washcloth 10 is used to carry articles, such as soap, a towel, a comb, and other toilet articles, the panel 11 is folded and the velcro fasteners 14 will keep washcloth 10 closed, enabling the user to carry washcloth 10 by its handles 13.

In use, washcloth 10 is folded for use on the face and other parts of the body, and when used on the back while bathing, it is unfolded and the handles 13 are grasped by its user to effectively wash the back area. When used to support and carry articles, the panel 11 is folded and the handles 13 are left outside for the hands of the user to grasp.

While various changes may be made in the detailed structure, such changes will be within the spirit and scope of the present invention, as defined by the appended claims.

What I now claim is:

1. A washcloth for use by a person to wash said person's face and back, said washcloth comprising, in combination:

(a) a rectangular panel having a first end and a second end; said panel having a length of at least approximately twice the width thereof;

(b) a first handle attached to said first end of said panel;

(c) a second handle attached to said second end of said panel;

(d) a first fastening means attached to said panel at said first end of said panel; and (e) a second fastening means attached to said panel at said second end of said panel;

said panel being movable between an unfolded position wherein said first handle can be grasped in one hand of said person and said second handle can be grasped in the other hand of said person to wash said person's back, and a folded position with said first and second ends of said panel positioned adjacent one another to form an approximately square shape for use to wash said person's face; said first and second fastening means coacting with one another to fasten said first and second ends of said panel to one another when said panel is in said folded position;

said panel being constructed of a single thickness of terrycloth, said first and second handles being constructed of a triple thickness of terrycloth.

2. A washcloth for use by a person to wash said person's face and back, said washcloth comprising, in combination:

(a) a rectangular panel having a first end and a second end; said panel having a length of at least approximately twice the width thereof;

(b) a first handle attached to said first end of said panel;

(c) a second handle attached to said second end of said panel;

(d) a first fastening means attached to said panel at said first end of said panel; and (e) a second fastening means attached to said panel at said second end of said panel;

said panel being movable between an unfolded position wherein said first handle can be grasped in one hand of said person and said handle can be grasped in the other hand of said person to wash said person's back, and a folded position with said first and second ends of said panel positioned adjacent one another to form an approximately square shape for use to wash said person's face; said first and second fastening means coacting with one another to fasten said first and second ends of said panel to one another when said panel is in said folded position; said panel having a front side and a rear side;

said first and second fastening means being attached to said rear side of said panel to allow said panel to be held in said folded position with all of said front side directed outward and all of said rear side directed inward;

said first and second handles being held between the fold of said panel when said panel is in said folded position.

* * * * *